US010596719B2

(12) United States Patent
Holm et al.

(10) Patent No.: US 10,596,719 B2
(45) Date of Patent: Mar. 24, 2020

(54) TREATMENT OF WOOD

(71) Applicant: DANISH WOOD TECHNOLOGY A/S, Copenhagen (DK)

(72) Inventors: Claus Holm, Hadsten (DK); Kell Thomas, Hadsten (DK)

(73) Assignee: DANISH WOOD TECHNOLOGY A/S, Copenhagen (DK)

( * ) Notice: Subject to any disclaimer, the term of this patent is extended or adjusted under 35 U.S.C. 154(b) by 73 days.

(21) Appl. No.: 15/690,559

(22) Filed: Aug. 30, 2017

(65) Prior Publication Data

US 2018/0009126 A1 Jan. 11, 2018

Related U.S. Application Data

(63) Continuation of application No. PCT/DK2016/050061, filed on Mar. 3, 2016.

(51) Int. Cl.

*B27K 3/02* (2006.01)
*B27K 5/00* (2006.01)
*B27K 3/08* (2006.01)

(52) U.S. Cl.

CPC ..... *B27K 3/0214* (2013.01); *B27K 3/08* (2013.01); *B27K 5/001* (2013.01); *B27K 5/007* (2013.01); *B27K 5/0085* (2013.01); *B27K 5/0055* (2013.01)

(58) Field of Classification Search

CPC .... F26B 5/058; F26B 2210/16; B27K 3/0214; B27K 5/001; B27K 5/0085; B27K 3/08; B27K 5/007; B27K 5/0055

See application file for complete search history.

(56) References Cited

U.S. PATENT DOCUMENTS 3,090,411 A 5/1963 Juncker et al.
3,986,268 A 10/1976 Koppelman
4,345,384 A * 8/1982 Pagnozzi ..... F26B 3/00 34/411
4,413,024 A 11/1983 Miyata et al.
4,654,277 A 3/1987 MacWilliams et al.
4,678,715 A 7/1987 Giebeler et al.
6,083,437 A 7/2000 Nishio et al.
6,124,584 A 9/2000 Blaker et al.

(Continued)

FOREIGN PATENT DOCUMENTS

DK 114049 B 5/1969
EP 373726 A2 6/1990

(Continued)

*Primary Examiner* — Jessica Yuen

(74) *Attorney, Agent, or Firm* — Lambert Shortell & Connaughton; Gary E. Lambert; David J. Connaughton, Jr.

(57) ABSTRACT

The present invention relates methods for heat treatment of wood. The invention further relates to wood obtainable by the methods of the invention as well as the use of the method for preparing treated wood. The method comprises the step of pressurising said airtight tank (4) to a predefined pressure ($P_1$) in order to establish a pressurised environment for said wood (6). The method comprises the step of placing said wood (6) in an airtight tank (4) and heating said wood (6) to a predefined temperature ($T_2$, $T_3$). The predefined pressure ($P_1$) is kept so high that the water in the wood (6) cannot evaporate at the predefined temperature ($T_2$, $T_3$).

12 Claims, 5 Drawing Sheets

(56) References Cited

U.S. PATENT DOCUMENTS

| | | | | |
|---|---|---|---|---|
| 2003/0189039 | A1 | 10/2003 | Vinden et al. | |
| 2004/0025367 | A1 | 2/2004 | Hottinen et al. | |
| 2008/0022548 | A1* | 1/2008 | Maynard | F26B 3/347 34/396 |
| 2008/0263891 | A1* | 10/2008 | Brunet | B27K 5/001 34/396 |
| 2011/0212273 | A1* | 9/2011 | Holm | B27K 3/0214 427/532 |
| 2016/0115337 | A1* | 4/2016 | Lu | C08K 3/04 428/424.4 |

FOREIGN PATENT DOCUMENTS

| | | | |
|---|---|---|---|
| EP | 0612595 | | 12/1996 |
| GB | 1467420 | A | 3/1977 |
| GB | 2158112 | A | 11/1985 |
| GB | 2271579 | A | 4/1994 |
| WO | 0058676 | A1 | 10/2000 |
| WO | 03037107 | | 5/2003 |
| WO | 03037107 | A2 | 5/2003 |
| WO | 2012136215 | A1 | 10/2012 |

* cited by examiner 62
64
72
74
60
P1
T1
T2
T3
t1
t2
t3
t4
t5
t6
I
II
III
IV
V
VI Fig. 5A
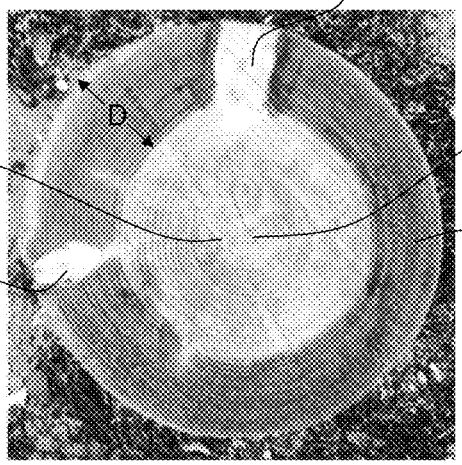
Fig. 5B
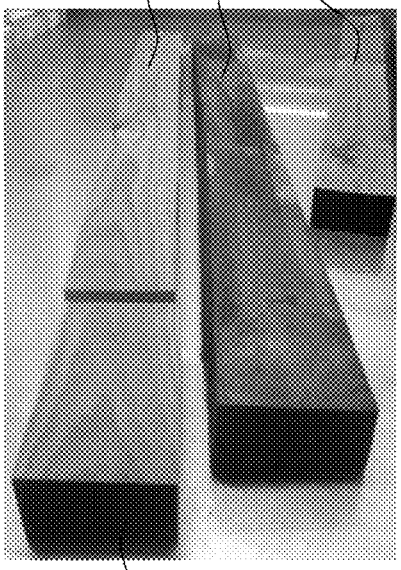
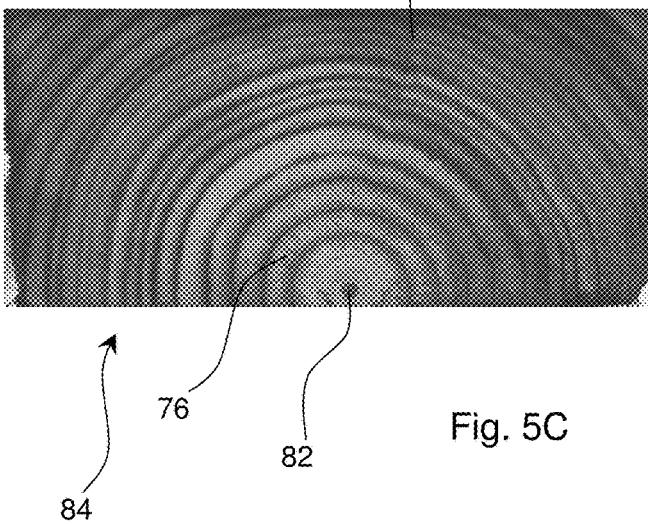
Fig. 5C

TREATMENT OF WOOD

FIELD OF INVENTION

The present invention relates a method for heat treatment of wood. The invention further relates to wood obtainable by the method of the invention as well as the use of the method for preparing treated wood. The present invention more particularly relates to methods providing improved properties of the wood. Still more particularly, the invention relates to uses of wood prepared according to the invention.

PRIOR ART

Various wood treatment techniques have been developed in order to enhance the properties of wood.

A commonly used wood treatment technique is described in the following. In order to expose the wood to adequate impregnation agents, the wood must be sufficiently dry. Usually, the fiber saturation point is about 26%, after which there is free water remaining in the cells. The pre-dried wood is placed in a treatment chamber and fastened to hold it in place and to hinder floating to the surface. The chamber then is closed. Usually, pre-vacuum is established in order to empty the chamber and to obtain a better penetration or through impregnation of the wood. Thus, an under-pressure is established in the chamber and in the wood. The impregnating liquid is then sucked into the wood by under-pressure in the chamber. During the filling, the pressure is usually increased either because filling happens too fast, or, the liquid evaporator/boiler and the steam pressure rise. After completion of the filling, the wood is soaked in the liquid. When the under-pressure is discontinued or equalised, the wood has absorbed a part of the fluid, thus, "vacuum impregnation" has taken place. Pressure is applied either by hydraulic pressure generated by a pressure pump pumping additional fluid into the chamber, or by establishing an air pressure above the liquid level. This forces additional liquid into the wood. The pressure is applied until either the desired amount of fluid is absorbed, or, until a proper saturation is reached. After completion of the pressure phase, the system is depressurised and emptied. However, an over-pressure may still be present in the wood, depending on the structure and density of the wood. In order to obtain a dry final product, an additional vacuum step may be run, whereby water present in the wood will be drawn due to the vacuum. A small volume of excess liquid is sucked out. More fluid is drawn, if a deeper ultimate vacuum is applied as compared to the pre-vacuum. Again, a negative pressure is established in the wood, as air equalization will force excess liquid from the surface of the wood. Thus, wood having a dried surface is obtained.

Other prior art techniques include heat-treatment of wood in order to dry the wood or to make the wood more resistant to microorganisms.

Heat treatment may be used to change the structural properties of wood and therefore several attempts have been made to provide applicable heat treatment methods. It has been found that heat treated wood has a decreased capability to absorb liquid (and thus water). Thermal modification of wood is typically carried out in order to produce chemical reactions in carbohydrates and lignin of the wood.

One common way of heating wood is to submerge the wood into hot oil. This method is associated with several drawbacks. First of all the treated wood contains oil. Secondly, the heating process must be carried out very slowly in order to avoid temperature gradients causing crack formation. Moreover, the process is expensive because both the wood, the tank and the oil must be heated.

Another way of conducting thermal modification of wood is to place the wood in a pressurised steam environment at temperatures in the range 160-190° C. This heating process, however, needs to be carried out very slowly in order to avoid temperature gradients causing crack formation.

EP 0 612 595 A1 relates to a method for upgrading low-quality wood to high-quality wood comprising the steps of (a) softening the wood by electrical heating in the presence of an aqueous medium, (b) drying the softened wood e.g. by dielectrically heating, (c) curing the dried wood, and (d) cooling the wood. By this method, the ohmic or dielectrically heating is applied both during the softening step and the drying step.

GB 22 715 79 A discloses a composition for the treatment of wood and a method of treating wood to retard the leaching of water-leachable wood treatment substances from treated wood. The method includes the step of applying a water/wax emulsion to the wood in a separate treatment step, after treating the wood with a water-leachable wood treatment substance, selected from the group consisting of water-leachable flame retardant substances and water-leachable biocidal wood preservative substances.

GB 14 67 420 A discloses a process for the preservation of a cellulosic material susceptible to degradation by wood destroying fungi. Wood is preserved by treatment with aqueous liquor containing 0.01-0.4 percent by wt. of an organotin compound having three organic groups bound to a tin atom through Sn—C lends and a mono-quaternary ammonium compound. The amount used must be sufficient to disperse the organotin compound (e.g. 0.02-5 percent by wt.) under conditions providing a leading of 0.15-1.5 kg of organotin compound per cubic meter of wood. Compositions for use in the disclosed process are in the form of a concentrate containing 1-20 percent by wt. of organotin compound and 20-90 percent by wt. of quaternary compound in water.

U.S. Pat. No. 6,124,584 A discloses a method of determining the moisture content of a charge of wood having a moisture content below fibre saturation and being subjected to a Radio Frequency (RF) dielectric heating process to the degree required to control the process (e.g. by terminating drying). When the predetermined moisture content is reached, the process is terminated. This is evaluated by measuring the wood product package dimensions and monitoring the RF power (kW) and RF voltage (kV) being applied to the charge of wood.

U.S. Pat. No. 3,986,268 A discloses a process and apparatus for accelerated drying of green lumber which employ high voltage dielectric heating at sub-atmospheric pressure to effect a rapid removal of moisture from the wood without splitting, checking, case hardening, honeycombing or similar damage to the wood structure. The process combines the dielectric and vacuum drying. The use of sub-atmospheric pressures in the drying process also permits injection of suitable chemicals for fireproofing or other specialized treatments of the wood allowing the combination of such treatments with the drying of the wood in a single process.

U.S. Pat. No. 6,083,437 A discloses a method for dimensional stabilization treatment, which enables externally supplied high pressure steam to permeate into the interior of wood or wood composite, thereby imparting high dimensional stability to the wood or wood composite. In the method, wood or wood composite to be treated is held in a sealed space between two press platens, the sealed space is evacuated to establish reduced pressure therein, and thereupon, high-pressure steam is supplied to the sealed space. The evacuation may be continued in parallel with the high-pressure steam supply.

WO 03/037107 A discloses a method and apparatus for treating wood, which includes arranging at least first and second electrodes in electrical contact with wood to be treated via an electrically conductive material and applying a voltage across the at least first and second electrodes. The wood is heated, under pressure, up to temperatures as high as 200° C. Typical applications of the wood treatment include wood sterilization, coloration and debarking.

Thus, there is a need for a method which enables an effective treatment of wood and reduces or even eliminates the above-mentioned disadvantages of the prior art.

SUMMARY OF THE INVENTION

In one aspect, the present invention relates to a method for heat treatment of wood. In another aspect, the present invention relates to uses of the method for the heat treatment of wood. In yet another aspect, the present invention relates to wood obtainable by the method as disclosed herein. Preferred embodiments are explained in the following description, illustrated in the accompanying drawings, and illustrated by the Examples.

In the broadest aspect, the method for heat treatment of wood according to the principles of the present invention comprises the steps of placing the wood to be treated in an airtight tank, and pressurising the airtight tank to a certain pressure in order to establish a pressurised environment for the wood. The wood is further heated to a predefined temperature by dielectric heating. The pressure during heating is such preventing the water present in the wood from evaporating at the predefined temperature. The tank may have any form and size suitable for performing the method.

In another aspect of the present invention, the method further comprises a cooling step and a drying step. It is to be understood that the method may comprise both a cooling step and a drying step, or only a cooling step or a drying step. For certain applications of the method of the invention, the drying process may be performed by reducing the pressure in the tank as the temperature in the tank is reduced.

In a certain embodiment of the present invention, the pressurising step and the step of heating takes place simultaneously. In another embodiment of the invention, the pressurising step is prior to the step of heating, i.e. firstly the airtight tank is pressurised for a certain time followed by heating for a certain time. It is to be understood, that the heating may be continued while the pressure being maintained in the airtight tank.

In another embodiment of the method, a water-containing liquid is present.

The water-containing liquid may in some applications suitably contain wood treatment compounds like impregnating agents such as alum, boric acid solution, copper, linseed oil, wood tar and the like, fire retardants, biocides, fungicides, and/or colorants as well as combinations thereof. It is to be understood that one or more of the wood treatment compounds may be present in the water-containing liquid in an amount suitable for the intended effect and application, but may depend on the type of wood and its moisture content. Wood treatment compounds as well as amount to be used are generally well-known in the art. In particular, the flame retardant may be a gaseous fire suppression substance suitable for extinguishing fire such as argon or halon.

In certain applications, the water-containing liquid comprises water only.

The water-containing liquid may suitably be present in an amount sufficiently to hinder the water present in the wood from evaporating during the heating step. The amount of water-containing liquid is generally dependent on the amount of wood, the moisture content of the wood as well as the pressure and the temperature applied.

The heat treatment may be carried out by using any suitable heating means. The heating is typically carried out either by ohmic heating or by dielectric heating.

Dielectric heating may be performed by applying electromagnetic radiation by means of one or more electrodes. It is possible to apply a first group of electrodes and a second group of electrodes configured to be inserted into a batch of stacked wood in the tank. The groups of electrodes may preferably be electrically connected to a high frequency generator by means of corresponding cables.

In one embodiment of the invention, the heating is performed for a period of time in the range of from minutes to hours, such as from 15 minutes to 10 hours, such as from 1-5 hours. The heating is preferably such, where the predefined temperature to which the wood is heated above the boiling point of water at atmospheric pressure, preferably above 140° C., preferably above 150° C., such as 170-215° C. Temperatures in this range are considered to be very efficient in order to conduct the required structural change of the wood.

In one embodiment of the invention, the predefined pressure is above 5 bar, such as 5-27 bar or even 5-20 bar. It is to be understood that the pressure may be 5, 6, 7, 8, 9, 10, 11, 12, 13, 14, 15, 16, 17, 18, 19, 20, 21, 22, 23, 24, 25, 26, or 27 bar as well as any non-integer therein between. The predefined pressure should be selected having regard to the predefined temperature and further in view of the vapor pressure in respect of the wood/liquid.

By the method of the present invention, it is possible to maintain the water content of the wood during the heating process. Accordingly, the wood will experience a structural change making the wood resistant to microorganisms. By such structural change, the sugary substances of the wood are decomposed. Decomposition takes place more rapidly at elevated temperatures for a prolonged period of time. E.g. at temperatures of 180° C. and above, the sugary substances will be degraded within a few hours. A structural change further provides for a prolonged soaking time of the wood, thus, the durability of the wood is markedly increased.

The wood is heated to a predefined temperature high enough to initiate the structural change making the wood resistant to microorganisms. Since the structural change implies degradation/decomposition of the sugary substances of the wood, thus, the growth of microorganisms is hindered.

Heat treatment causes decomposition of the content of the wood, especially the sugary substance hemicellulose. Accordingly, the wood will be less moisture adsorbent. The wood will be more stable and more resistant to fungal attack and to microorganisms.

As described above, the method comprises the step of pressurising the airtight tank to a predefined pressure in order to establish a pressurised environment for the wood to prevent the water in the wood from evaporating. In general, the predefined pressure should be determined so as to maintain and not exceed the pressure of saturated vapour pressure of the water present in the wood at the predefined temperature. As described above, a water-containing liquid may suitably be supplied to facilitate the maintenance of saturated vapour pressure of water present in the wood.

However, the amount of water-containing liquid applied may exceed the minimum content necessary to maintain equilibrium.

The applied pressure prevents that the mechanical properties of the wood are influenced in a negative direction during the heat treatment (e.g. distortion of the wood). The use of a pressurised environment increases the boiling point of water.

By providing a pressurised environment, damaging effects caused by heat-introduced steam pressure may be reduced or may even be eliminated.

Conventional thermal modification of wood suffers from the drawback that the heat introduced steam pressure reduces the mechanical properties of the wood.

Thus, in one embodiment, the predefined pressure is kept high as long as the temperature is increased.

By the method described herein, it is possible to provide wood having a specific (predefined) wood moisture content. This may be accomplished by controlling the applied pressure and temperature.

The actual pressure level is determined when the heating temperature has been chosen. The heating temperature may depend on the type of wood.

The predefined pressure level is determined on the basis of the required heating temperature in such a way that the water in the wood will not evaporate. This requires that the pressure is kept above a pressure level that depends on the heating temperature.

Due to the fact that the wood is kept in a pressurised tank during the heating process, the water (in the wood) can be heated far beyond the standard 100° C. without boiling. In other words, the pressured tank is capable of keeping the water in liquid phase at high temperatures.

It may be advantageous that the method comprises a step of cooling.

The cooling step may suitably be performed in various ways. Such include:

- discontinuing the heating step and allowing the wood and the other substances present in the airtight tank to cool,
- discontinuing the heating step and circulate air or a vapour in the airtight tank,
- discontinuing the heating step and cooling the wood and the other substances present in the airtight tank by use of cooling means present in the interior or on the exterior of the airtight tank,
- discontinuing the heating step and supplying a cooling medium or additional water-containing liquid or both supplying a cooling medium and additional water-containing liquid,
- discontinuing the heating step and withdrawing some or all of the water-containing liquid to e.g. an external tank or reservoir having cooling means, followed by recirculating of the cooled water-containing liquid to the airtight tank, optionally repeating the withdrawal/recirculation.

It is to be understood that combinations of one or more of the above-mentioned cooling options may be chosen, if suitable.

The cooling medium may also in certain embodiments be selected among water-containing vapour and water-containing liquids. Thus, the cooling medium may in some applications suitably be the same as the water-containing liquid, or the cooling medium may be the water-containing liquid, however, containing wood treatment compounds different from the wood treatment compounds of water-containing liquids already present in the airtight tank. Thus, the cooling medium may comprise wood treatment compounds in addition to the wood treatment compounds of the water-containing liquid present in the airtight tank. In accordance herewith, the cooling medium may comprise wood treatment compounds such as impregnating agents such as alum, boric acid solution, copper, linseed oil, wood tar and the like, fire retardants, biocides, fungicides, and/or colorants as well as combinations thereof. Such wood treatment compounds are generally well-known in the art.

The cooling medium may have a temperature lower than the wood in order to provide efficient cooling. Suitably, the temperature of the cooling medium is approximately or below 20-25° C. In some applications, the cooling medium may have a higher temperature, whereby the rate of cooling can be controlled. Such controlled cooling may suitably be accomplished using external or internal cooling means as described above.

The cooling step may suitably be continued for 1-5 hours, such as for 2 hours. The pressure during the cooling step is suitably controlled and adapted having regard to the temperature.

In one embodiment of the method according to the invention, the step of cooling the wood by means of a cooling medium that is stored in a reservoir connected to the tank and filling the cooling medium into the tank by means of a pump.

As mentioned above, the method may suitably comprise the step of subjecting the wood to a subsequent drying process after the heating process. Hereby, it is possible to both making the wood resistant to microorganisms and provide dry wood.

During the drying process, it is possible to provide a predefined (desired) wood moisture content. This can be done by reducing the pressure according to temperature. By reducing the pressure as the temperature is reduced, it is possible to prevent deformations, such as twisting and bending, of the wood. Deformations could potentially impair the mechanical properties of the wood.

In some embodiments, the drying process is carried out by heating the wood in a tank pressurised to a pressure that allows for evaporation of the water in the wood.

In another aspect, the present invention relates to wood obtained by the applying the method described herein.

The yet another aspect, the present invention relates to the use of the method described herein for treating wood.

The invention has several further aspects, which includes uses of the wood obtained by the method of the invention. Such uses are e.g. construction, engineered wood, floorings, and marine applications. Particular uses include furniture, interior cladding, roof trusses, exterior timbers under cover, external joinery, such as windows and doors, external cladding, garden timbers, transmission poles, railway sleepers, fence posts, bridges, wharf timbers, jetties, and piles.

DESCRIPTION OF THE DRAWINGS

The invention will become more fully understood from the detailed description given hereof below. The accompanying drawings are provided by way of illustration only, and thus, they are not limitative of the present invention. In the accompanying drawings:

FIG. 5A illustrates traditional impregnation wood for comparison. The traditional impregnation was accomplished using vacuum (40 minutes) followed by pressurisation (3 hours);

FIG. 5B illustrates wood impregnated according to the invention (combination of pressurisation and heating); and FIG. 5C illustrates wood fully impregnated according to the invention.

DETAILED DESCRIPTION OF THE INVENTION

Figure 1A:
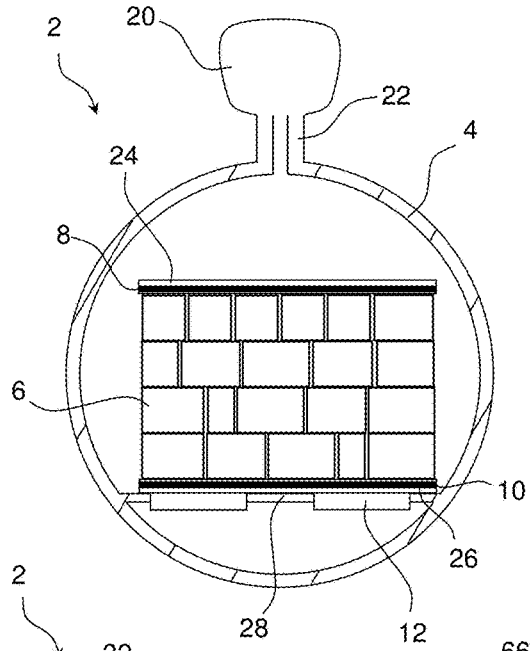
FIG. 1A shows a first schematic cross-sectional view of an apparatus for heat treatment of wood according to the invention.

Referring now in detail to the drawings for the purpose of illustrating preferred embodiments of the present invention, a schematic cross-sectional view of an apparatus 2 of the present invention is illustrated in FIG. 1A.

Figure 1B:
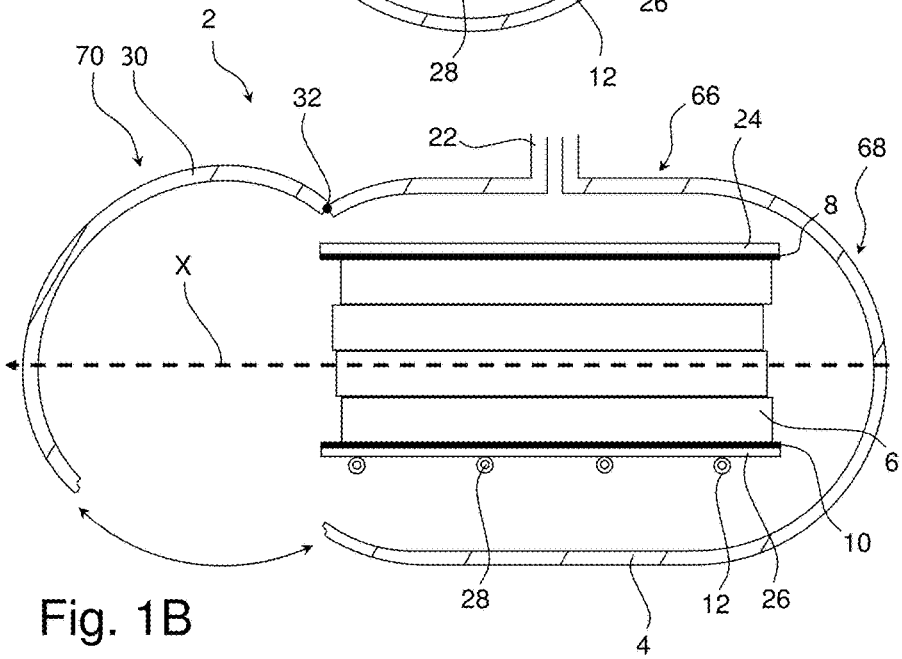
FIG. 1B shows a second schematic cross-sectional view of the apparatus shown in FIG. 1 A.

FIG. 1A illustrates a schematic cross-sectional view of an apparatus 2 for heat treatment of wood 6 according to the invention. FIG. 1B illustrates another schematic cross-sectional view of the apparatus 2 shown in FIG. 1A.

The heat treatment apparatus 2 comprises a tank 4 having a cylindrically shaped portion 66 extending along the longitudinal axis X of the tank 4. FIG. 1A illustrates that the cross section of the cylindrically shaped portion 66 is circular. A tube 22 is provided in the top portion of the tank 4. This tube 22 connects the tank 4 with compressor 20 configured to pressurise the tank 4.

A shaft 28 is rotably mounted to the lower portion of the tank 4. Two roller members 12 are rotably mounted to the shaft 28. FIG. 1B illustrates that four parallel shafts 28 are provided at the lower portion of the tank 4. These shafts 28 and the roller members 12 attached to them constitute a roller conveyer.

A plurality of wood boards 6 is stacked in the tank 4. The wood boards 6 rest on a lower plate-shaped support member 26 and are sandwiched between the lower support member 26 and an upper plate-shaped support member 24.

A first electrode 8 is provided at the upper support member 24, while a second electrode 10 is provided at the lower support member 26.

The tank 4 comprises a first closed end portion 68 and another end portion 70. An opening is provided at the end portion 70. The end portion 70 comprises a tank door 30 rotably attached to the remaining portion of the tank 4 by means of a joint 32. Accordingly, the tank door can be opened in order to fill wood 6 into the tank 4 or to remove heat-treated wood 6 from the tank 4. The use of the roller conveyer 12, 28 eases these processes.

When wood boards 6 have been arranged in the tank 4, and the tank has been closed, the heat treatment may be initiated. The heat treatment is carried out by means of heating by electromagnetic radiation through one or more electrodes.

Although not shown, the electrodes 8, 10 may be electrically connected to a (high frequency) generator configured to generate the required electromagnetic radiation, e.g. within the range 1-40 MHz, such as 10-30 MHz, e.g. about 13.56 MHz. It may be preferred that the frequency of the electromagnetic radiation is approximately 13.56 MHz or approximately 27.12 MHz, since it has been shown that the heating of wood is very efficient at these frequencies.

Generation of heat will, however, not be initiated before the pressure in the tank 4 exceeds a predefined pressure level e.g. between 5-27 bar, such as 20 bar. The predefined pressure level is determined on the basis of the required heating temperature in such a manner that the water in the wood will not boil (change into a gas). This requires that the pressure is kept above a pressure level depending on the heating temperature.

Since the tank 4 is a pressurised chamber, the water (in the wood) can be heated far beyond the standard 100° C. without boiling. In other words, the pressured tank 4 is capable of keeping the water in liquid phase at high temperatures.

The compressor 20 may be controlled by a control member (not shown) e.g. shaped as a control box electrically connected to the compressor and to one or more pressure sensors (not shown).

The heating may be initiated when the desired pressure is established in the tank 4. Once the desired temperature is reached, this temperature may be maintained for a predefined period. It is possible to change the temperature and/or pressure in the tank once or several times and maintain a fixed temperature and/or pressure for a predefined period.

It may be an advantage to arrange a pressure sensor (not shown) in the tank 4 or in the tube 22. A pressure sensor may be applied to detect the pressure and thus to control the wood treatment process.

By using high frequency electromagnetic radiation, it is possible to conduct a homogeneous heating of the wood. Hereby, it is possible to provide a homogeneous wood quality.

Figures 2A, 2B, 2C, 2D, 2E, 2F, 2G, 2H:
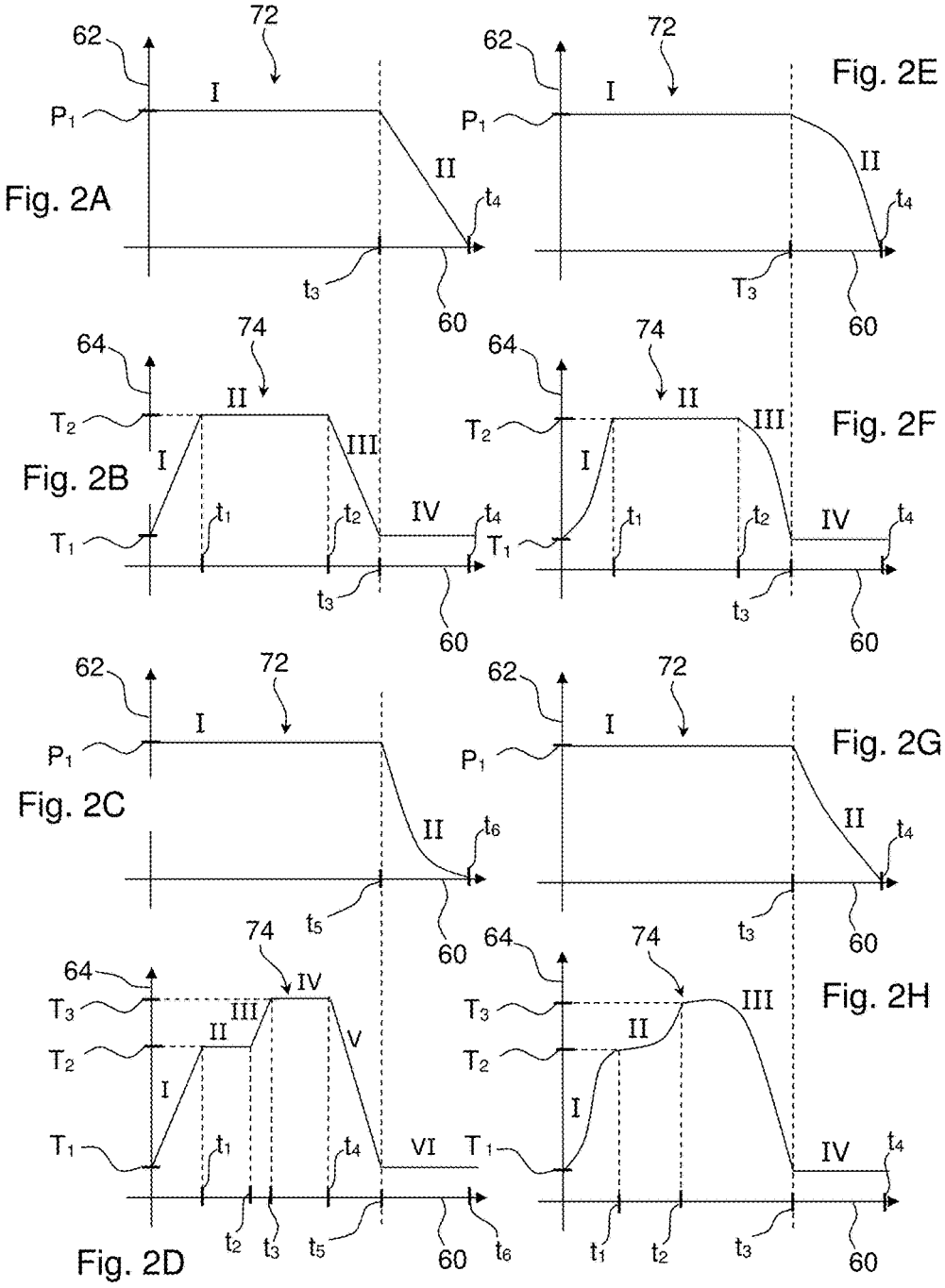
FIG. 2A shows a pressure versus time curve of a first method according to the invention.
FIG. 2B shows a temperature versus time curve of the first method according to the invention.
FIG. 2C shows a pressure versus time curve of a second method according to the invention.
FIG. 2D shows a temperature versus time curve of the second method according to the invention.
FIG. 2E shows a pressure versus time curve of a third method according to the invention.
FIG. 2F shows a temperature versus time curve of the third method according to the invention.
FIG. 2G shows a pressure versus time curve of a fourth method according to the invention.
FIG. 2H shows a temperature versus time curve of the fourth method according to the invention.

FIG. 2A illustrates a pressure 62 versus time 60 curve 72 of a first method according to the invention. Pressure 62 is plotted against time 60.

The curve 72 has a first section I, in which section I the pressure 62 is kept at a constant level $P_1$. The curve 72 has a second section II, in which section II the pressure is reduced (linearly) with a constant rate. The duration of the first section I is $t_3$, while the duration of the second section II is $t_4-t_3$.

FIG. 2B illustrates a temperature versus time curve 74 corresponding to the method referred to with reference to FIG. 2A. The curve 74 comprises a first section I in which the temperature 64 is linearly increased from a first temperature $T_1$ to a second temperature $T_2$. When the temperature $T_2$ has been reached at the time $t_1$, the temperature $T_2$ is maintained to time $t_2$. The constant temperature period is the second section II of the curve 74.

At time $t_2$ the temperature 64 is linearly decreased until a temperature $T_1$ is reached at the time $t_3$. This time period corresponds to the third section III of the curve 74. The temperature $T_1$ is kept constant in the fourth section IV of the curve 74 extending between time $t_3$ and time $t_4$.

When comparing FIG. 2A and FIG. 2B one can see that a high pressure $P_1$ is maintained during the complete high temperature phase (section II). This means that the water in the wood will not evaporate. Accordingly, the desired structural changes of the wood will occur.

FIG. 2C illustrates a pressure versus time curve 72 of a second method according to the invention.

The curve 72 has a first section I, in which the pressure 62 is kept at a constant level $P_1$. The curve 72 has a second section II, in which the pressure is reduced with a decreasing rate. The duration of the first section I is $t_5$, whereas the duration of the second section II is $t_6-t_5$.

FIG. 2D illustrates a temperature versus time curve 74 corresponding to the method referred to with reference to FIG. 2C. The curve 74 comprises a first section I in which the temperature 64 is linearly increased from a first temperature $T_1$ to a second temperature $T_2$. When the temperature $T_2$ has been reached at the time $t_1$, the temperature $T_2$ is maintained to time $t_2$. The constant temperature period is the second section II of the curve 74.

At time $t_2$ the temperature 64 is linearly increased until a temperature $T_3$ has been reached at the time $t_3$. This time period corresponds to the third section III of the curve 74. The temperature $T_3$ is kept constant in the fourth section IV of the curve 74 extending between time $t_3$ and time $t_4$. The temperature 64 is linearly decreased during the fifth section V of the curve 74 extending between time $t_4$ and time $t_5$. Hereafter a sixth section VI (between time $t_5$ and $t_6$) with a constant temperature $T_1$ follows.

FIG. 2E illustrates a pressure 62 versus time 60 curve 72 of a third method according to the invention. Pressure 62 is plotted against time 60.

The curve 72 has a first section I, in which section I the pressure 62 is kept at a constant level $P_1$. The curve 72 has a second section II, in which section II the pressure is reduced with an increasing rate. The duration of the first section I is $t_3$, while the duration of the second section II is $t_4-t_3$.

FIG. 2F illustrates a temperature versus time curve 74 corresponding to the method referred to with reference to FIG. 2E. The curve 74 comprises a first section I in which the temperature 64 is increased from a first temperature $T_1$ to a second temperature $T_2$. When the temperature $T_2$ has been reached at the time $t_1$, the temperature $T_2$ is maintained to time $t_2$. The constant temperature period is the second section II of the curve 74.

At time $t_2$ the temperature 64 is decreased until a temperature $T_1$ is reached at the time $t_3$. This time period corresponds to the third section III of the curve 74. The temperature $T_1$ is kept constant in the fourth section IV of the curve 74 extending between time $t_3$ and time $t_4$.

FIG. 2G illustrates a pressure versus time curve 72 of a fourth method according to the invention.

The curve 72 has a first section I, in which the pressure 62 is kept at a constant level $P_1$. The curve 72 has a second section II, in which the pressure is reduced with a decreasing rate. The duration of the first section I is $t_3$, whereas the duration of the second section II is $t_4-t_3$.

FIG. 2H illustrates a temperature versus time curve 74 corresponding to the method referred to with reference to FIG. 2G. The curve 74 comprises a first section I in which the temperature 64 is increased from a first temperature $T_1$ to a second temperature $T_2$. When the temperature $T_2$ has been reached at the time $t_1$, the temperature 64 is further raised until time $t_2$. The period is the second section II of the curve 74.

At time $t_2$ a slight temperature increase is followed by a temperature decrease until a temperature $T_1$ has been reached at the time $t_3$. This time period corresponds to the third section III of the curve 74. The temperature $T_3$ is kept constant in the fourth section IV of the curve 74 extending between time $t_3$ and time $t_4$.

The methods explained with reference to FIG. 2 applies a pressure P1 that ensures that the water in the wood does not evaporate all though a high temperature is maintained in the tank. Accordingly, it is possible to provide the desired heat-induced structural changes in the wood.

Figure 3:
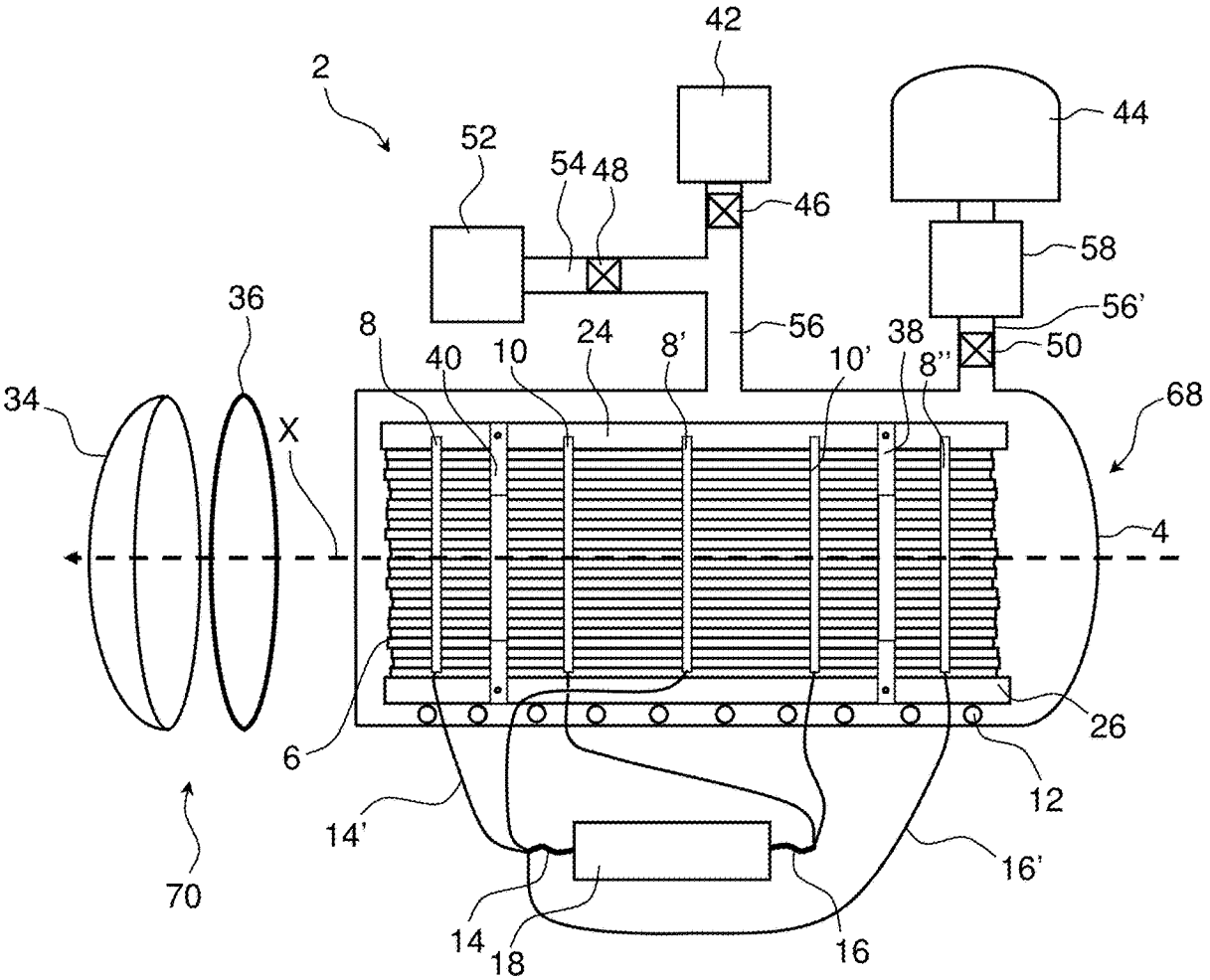
FIG. 3 shows a schematic cross-sectional view of an apparatus for heat treatment of wood according to the invention.

FIG. 3 illustrates a schematic cross-sectional view of an apparatus 2 for heat treatment of wood 6 according to the invention.

The heat treatment apparatus 2 comprises a tank 4 having a cylindrically shaped portion extending along the longitudinal axis X of the tank 4. A first tube 56 and a second tube 56' are provided in the top portion of the tank 4. The first tube 56 connects the tank 4 with a reservoir 42 and a compressor 52 via a tube 54. The compressor 52 is configured to pressurise the tank 4.

A valve 48 is provided in the tube 54 between the compressor 52 and the tank 4. The valve is configured to establish and disconnect fluid communication between the compressor 52 and the tank 4. The compressor 52 may be controlled by a control member (not shown) e.g. shaped as a control box electrically connected to the compressor 52 and to one or more pressure sensors (not shown).

Another valve 46 is provided between the reservoir 42 and the tank. The valve 46 is adapted to establish and disconnect fluid communication between the reservoir 42 and the tank 4. The reservoir may contain any fluid of interest e.g. a wood preservation liquid.

A pump 58 is connected to the tube 56'. A valve 50 is provided between the pump 50 and the tank 4. By means of the valve 50 it is possible to establish fluid communication between the tank 4 and the pump 58. On the other hand, by closing the valve 50, it is possible to shut off the connection between the tank 4 and the pump 58. A reservoir 44 is provided above the pump 58. The reservoir 44 is in fluid communication with the pump 58. Accordingly, the pump 58 may be used to pump e.g. a cooling fluid from the reservoir 44 into the tank 4 and to pump the fluid back into the reservoir.

Ten shafts are rotably mounted to the lower portion of the tank 4. A number of roller members 12 are rotably mounted to the shafts. The shafts and the roller members 12 attached to them constitute a roller conveyer for easing transport of wood into the tank 4 and out of the tank 4.

A plurality of wood boards 6 is stacked in the tank 4. The wood boards 6 are resting on a lower plate-shaped support member 26. The wood boards 6 are sandwiched between the lower support member 26 and an upper plate-shaped support member 24.

A first group of electrodes 8, 8', 8" and a second group of electrodes 10, 10' have been inserted into the batch of stacked wood 6. The groups of electrodes are electrically connected to a HF (high frequency) generator 18 by cables 14, 14' and 16, 16' in such a manner that, when operating the generator 18, the first group 8, 8', 8" has a polarity being opposite to that of the second group 10, 10'. The electrodes 8, 8', 8", 10, 10' are arranged in such a way that two neighbouring electrodes have opposite polarity.

The electrodes 8, 8', 8", 10, 10', the associated cables 14, 14' and 16, 16' and the HF-generator 18 constitute an electrode system, which is capable of producing electromagnetic radiation in the frequency range of approximately 10 MHz to approximately 30 MHz.

The plate-shaped upper support plate 24 and the lower plate-shaped support plate 26 are connected by a first clamp 38 and a second clamp 40. The clamps 38, 40 provide a compression force pressing the two support plates 24, 26 together. The compression force will counteract deformations, such as twisting and bending, of the wood boards 6 caused by the heating process. The clamps 38, 40, and the upper 24 and lower 26 support plates constitute a compression system configured to prevent deformations of the wood 6 during the heating process.

The tank 4 comprises a first closed end portion 68 and another end portion 70. An opening is provided at the end portion 70. The end portion 70 comprises a detachable tank door 34 configured to be detachably attached to the remaining portion of the tank 4. A sealing member shaped as an O-ring 36 is provided next to the door 34.

The tank door 34 can be removed in order to fill wood 6 into the tank 4 or to remove heat-treated wood 6 from the tank 4. The use of the roller members 12 eases these processes.

After arranging the wood boards 6 in the tank 4 and closing the tank, the heat treatment may be initiated. The heat treatment is carried out by means of the electrode system, which is capable of producing electromagnetic radiation in the frequency range of approximately 10 MHz to approximately 30 MHz.

The heat generation will not be initiated before the pressure in the tank 4 exceeds a predefined pressure level e.g. between 5-27 bar, such as bar. Examples of such treatment method are illustrated in FIG. 2.

It may be an advantage to arrange a pressure sensor (not shown) in the tank 4 or in one of the tubes 54, 56. Accordingly, the pressure sensor may be applied to detect the pressure and thus to control the wood treatment process.

By using high frequency electromagnetic radiation, it is possible to conduct a homogeneous heating of the wood. Hereby, it is possible to provide a homogeneous wood quality.

Figure 4:
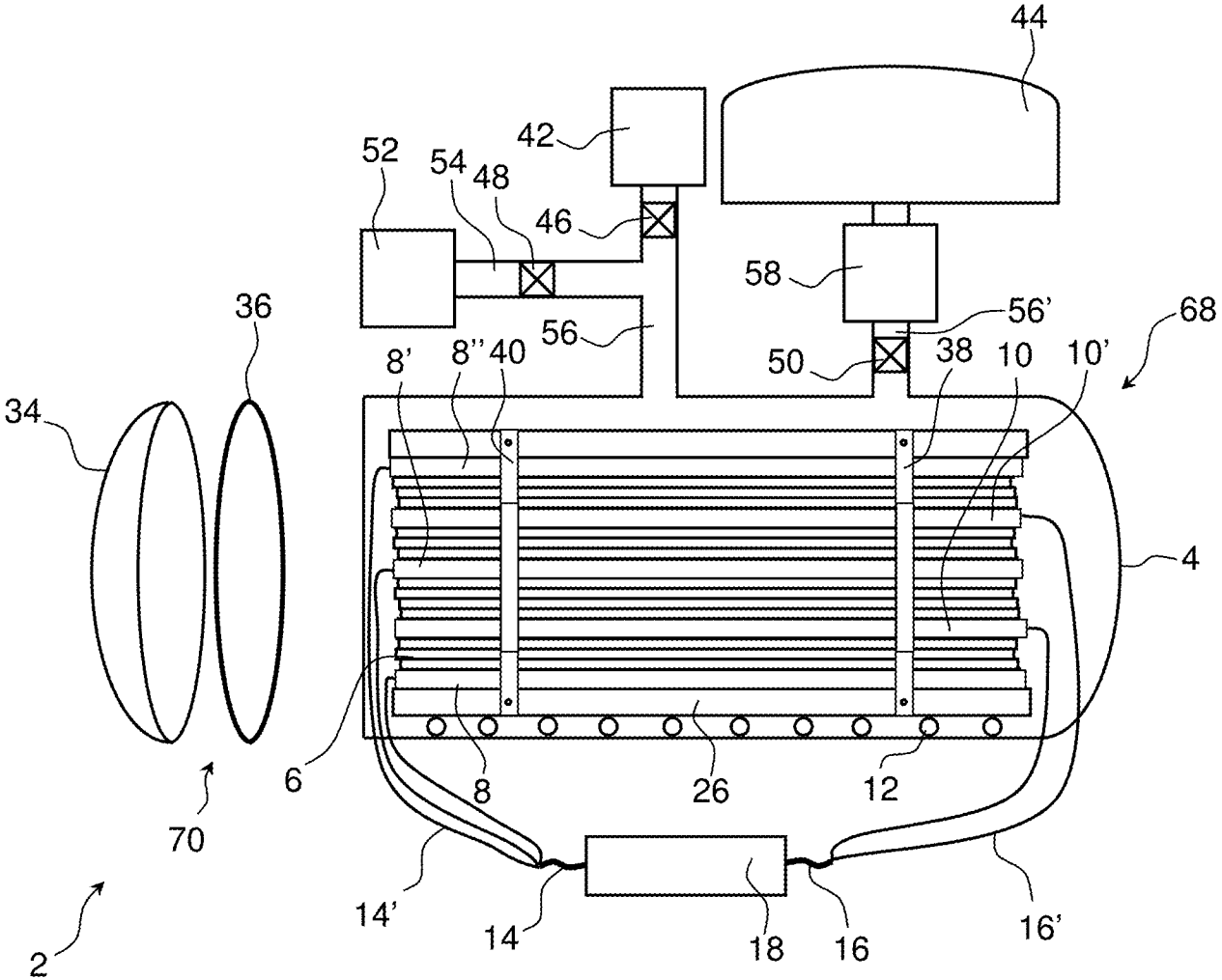
FIG. 4 shows a schematic cross-sectional view of another apparatus for heat treatment of wood according to the invention.

FIG. 4 illustrates a schematic cross-sectional view of an apparatus 2 for heat treatment of wood 6 according to the invention. The apparatus 2 basically corresponds to the apparatus 2 shown in FIG. 3.

The apparatus 2 comprises a tank 4 having a central cylindrically shaped portion extending and two end portions 68, 70. The first end portion 68 is an integrated part of the tank 4. The second end portion 70, however, is configured to be detachably attached to the opposite (open) portion of the tank 4. The second end portion 70 comprises a door 34 and an O-ring 36 adapted to be applied for the purpose of sealingly attach the door 34 to the remaining portion of the tank 4.

A first tube 56 and a second tube 56' are provided in the top portion of the tank 4. The first tube 56 connects the tank 4 with a reservoir 42 and a compressor 52 via another tube 54. The compressor 52 is adapted to pressurise the tank 4.

A compressor valve 48 is arranged in the tube 54 between the compressor 52 and the tank 4. The compressor valve 48 is configured to establish communication between the compressor 52 and the tank 4 and to disconnect this fluid communication. The compressor 52 may be controlled by any suitable control member (not shown), such as a control box, which is electrically connected to the compressor 52 and optionally to one or more pressure sensors.

A reservoir valve 46 is provided between the reservoir 42 and the tank 4. The reservoir valve 46 is configured to establish communication between the reservoir 42 and the tank 4 and to limit or completely shut off this fluid communication. The reservoir 42 may contain any fluid of interest e.g. a wood preservation liquid. The apparatus 2 may be configured to perform several treatment processes including impregnation of a wood preservation liquid.

A pump 58 is connected to the tube 56'. A pump valve 50 is arranged between the pump 50 and the tank 4. It is possible to establish fluid communication between the tank 4 and the pump 58 by means of the pump valve 50.

Further, by at least partly closing the valve 50, it is possible to decrease the flow or even completely shut off the connection between the tank 4 and the pump 58. A reservoir 44 is provided above the pump 58. The reservoir 44 is arranged in fluid communication with the pump 58. Therefore, the pump 58 can be used to pump e.g. a cooling fluid from the reservoir 44 into the tank 4 and to pump the fluid back into the reservoir 44.

Ten shafts are rotably mounted to the lower portion of the tank 4. A number of roller members 12 are rotably attached to the shafts. The shafts and the attached roller members 12 constitute a roller conveyer configured to ease the transport of wood into the tank 4 and out of the tank 4.

A plurality of wood boards 6 is stacked in the tank 4. The wood boards 6 are resting on a lower plate-shaped support member 26. The wood boards 6 are sandwiched between the lower support member 26 and an upper plate-shaped support member 24.

A first group of electrodes 8, 8', 8" and a second group of electrodes 10, 10' have been inserted into the batch of stacked wood 6. The groups of electrodes are electrically connected to a HF (high frequency) generator 18 by cables 14, 14' and 16, 16' in such a manner that, when operating the generator 18, the first group 8, 8', 8" has a polarity being opposite to that of the second group 10, 10'. The electrodes 8, 8', 8", 10, 10' are arranged in such a way that two neighbouring electrodes have opposite polarity.

The electrodes 8, 8', 8", 10, 10', the associated cables 14, 14' and 16, 16' and the HF-generator 18 constitute an electrode system, which is capable of producing electromagnetic radiation in the frequency range of approximately 10 MHz to approximately 30 MHz.

The plate-shaped upper support plate 24 and the lower plate-shaped support plate 26 are connected by a first clamp 38 and a second clamp 40. The clamps 38, 40 provide a compression force pressing the two support plates 24, 26 together. The compression force will counteract deformations, such as twisting and bending, of the wood boards 6 caused by the heating process. The clamps 38, 40, and the upper 24 and lower 26 support plates constitute a compression system configured to prevent deformations of the wood 6 during the heating process.

After arranging the wood boards 6 in the tank 4 and closing the tank, the heat treatment may be initiated. The heat treatment is carried out by means of the electrode system, which is capable of producing electromagnetic radiation in the frequency range of approximately 10 MHz to approximately 30 MHz.

The heat generation will not be initiated before the pressure in the tank 4 exceeds a predefined pressure level e.g. between 5-27 bar, such as bar. Examples of such treatment method are illustrated in FIG. 2.

It may be an advantage to arrange a pressure sensor (not shown) in the tank 4 or in one of the tubes 54, 56. Accordingly, the pressure sensor may be applied to detect the pressure and thus to control the wood treatment process.

By using high frequency electromagnetic radiation, it is possible to conduct a homogeneous heating of the wood. Hereby, it is possible to provide a homogeneous wood quality.

The method of the invention is further illustrated by the following nonlimiting examples.

EXAMPLES

Example 1

All tests were conducted and approved by The Danish Technological Institute in Denmark where a laboratory machine owned by DWT A/S was installed. Tests were performed using logs of wood (Pine, Spruce, Oak and Meranti Mahogany) with dimensions 1200×45×95 mm having a moisture content of 20-25%. The logs of wood were subjected to treatment with a selection of solutions (liquids) selected from water containing colour pigment, alum (5%, 10%, 20%), boric solution (20%), and copper, respectively. The logs of wood were treated using the method of the invention by which the logs of wood were subjected to a pressuring step, and a heating step. The results are presented in Example 2.

Example 2

The logs of wood treated according to Example 1 were analysed for uptake of different liquids at various concentrations. The results are indicated in Table 1. "Full imp." denotes "full impregnation". The uptake of the various solutions were determined on the basis of the weight of the logs before and after being treated using the method according to the invention.

TABLE 1

Test results.

| Liquid | Pine | Spruce (25%) | Oak | Meranti Mahogany |
|---|---|---|---|---|
| Water with colour pigment | 579 kg/m$^3$ | 478 kg/m$^3$ | 340 kg/m$^3$ | 307 kg/m$^3$ |
| Alum 5% solution | Full imp. | Full imp. | | |
| Alum 10% solution | Full imp. | Full imp. | | |
| Alum 20% solution | Full imp. | Full imp. | | |
| Boric solution 20% | Full imp. | | | |
| Wood tar/linseed oil 50/40 | | | +300 kg/m$^3$ | |
| Copper (Celcure AC800) | Full imp. | 438 kg/m$^3$ | | |

The results confirms that the method according to the invention can be controlled so as to provide complete or partial absorption of liquids through the wood. The laboratory plant has further proven a stable production of Spruce and Pine wood, where alum, and copper have been recorded by more than 400 kg per m3 of wood.

Tests performed document that the method of the invention makes it possible to achieve full impregnation into heartwood. Test performed further document that the method of the invention makes it possible to applicate both water-based and oil-based liquids to wood and achieve full impregnation into heartwood.

Example 3

The impregnation depth is a very important parameter in the treatment of wood. The impregnation depth determines the possible uses of the wood and the durability thereof. Most countries apply very strict regulations to outdoor uses of impregnated wood as well as to fire resistance, durability and resistance towards rot and fungi. Furthermore, impregnated wood must also fulfil demands as regards environmental issues and human health issues due to the use of chemicals and biocides in the impregnation process.

In general, the following impregnation depths are required:

- Full impregnation of Spruce wood (25% humidity) and Pine heartwood, which both cannot be impregnated using traditional treatments.
- Full impregnation for manufacturing of wood being fire resistant, having extremely long lifecycle (marina piles) and for building structural elements.
- 6 mm impregnation for manufacturing of wood with increased durability and fire resistance performances, for outdoor application in several (most common) field of application.
- 3 mm impregnation for manufacturing of wood with improved characteristics included aesthetics, for instance for furnishing and flooring.

The logs treated and analysed in Example 1 and 2 were subjected to inspection as regards impregnation depth. The results are shown in FIG. 5. FIG. 5A illustrates traditional impregnation wood for comparison. The traditional impregnation was accomplished using vacuum (40 minutes) followed by pressurization (3 hours). FIG. 5B illustrates wood 84 impregnated according to the invention (combination of pressurisation and heating). FIG. 5C illustrates wood 84 fully impregnated by the method according to the invention. Accordingly, the sapwood 80, the heartwood 76 and the pith 82 of the heat treated wood 84 can be impregnated by using by the method according to the invention. Moreover, gnarl 78, 78' (not shown) can be impregnated by using by the method according to the invention.

In FIG. 5A it can be seen that the impregnation depth D corresponds to approximately one sixth of the thickness of the wood. This means that only the periphery of the wood is impregnated. Accordingly, only a portion of the sapwood 80 is protected by the impregnation. Neither the heartwood 76, the pith 82 nor the gnarl 78, 78' are impregnated.

As the tests performed document, the method of the invention provides the following benefits:

- Full impregnation of wood both with oil-based, salt-based and water based solutions.
- Full impregnation of softwood like wet Spruce (25% humidity) and Pine.
- Full impregnation of hardwood like Mahogany and Oak.
- Full penetration to heartwood (+50 mm).
- Impregnation can be achieved without pre-drying the wood.
- Handling of wood tar and linseed oil as paint is usually not adequate for the modern building industry. Ideally, wood tar and linseed oil should be applied 3-5 times on the particular wood surface with a drying range of one week per supply. The method of the invention allows full application of wood tar and linseed oil directly into the raw wood in the treatment process.

LIST OF REFERENCE NUMERALS

2 Wood treatment apparatus
4 Tank

6 Wood
8, 8', 8", 10, 10" Electrode
12 Roller member (roller conveyer)
14, 16 Cable
18 HF Generator
20 Compressor
22 Tube
24 Upper support member
26 Lower support member
28 Shaft
30 Door
32 Joint
34 Door
36 Sealing member (O-ring)
38, 40 Clamp member
42, 44 Reservoir
46, 48, 50 Valve
52 Compressor
54, 56, 56' Tube
58 Pump
60 Time
62 Pressure
64 Temperature
$P_1$ Pressure
$T_1$, $T_2$, $T_3$ Temperature
$t_1$, $t_2$, $t_3$, $t_4$, $t_5$, $t_6$ Time
X Longitudinal axis
66 Cylindrical portion
68, 70 End portion
72, 74 Curve
76 Heartwood
78, 78' Gnarl
80 Sapwood
82 Pith
84 Heat treated wood
D Impregnation depth
I, II, III, IV, V, VI Section

The invention claimed is:

1. A method for heat treatment of wood comprising the steps of placing said wood in an airtight tank, pressurising said airtight tank to a predefined pressure from 5-27 bar to establish a pressurised environment for said wood, heating said wood to a predefined temperature from 140° C. to 215° C. by dielectric heating, wherein the step of pressurising and the step of heating is performed simultaneously, or wherein the step of pressurising is carried out prior to the step of heating, wherein the predefined pressure during heating prevents water present in the wood from evaporating at the predefined temperature, and wherein the heating is performed without adding any fluid to the tank.

2. The method according to claim 1, wherein the dielectric heating is electromagnetic radiation.

3. The method according to claim 2 wherein a frequency of the electromagnetic radiation is 1-40 MHz.

4. The method of claim 1 wherein the dielectric heating is electromagnetic radiation by means of one or more electrodes.

5. The method of claim 1 wherein the heating is performed for a period of time in the range of 15 minutes to 10 hours.

6. The method of claim 1 wherein the predefined temperature is between 170° C. and 215° C.

7. The method of claim 1 further comprising at least one of the steps of:

cooling said wood, and drying said wood.

8. The method of claim 7, wherein the cooling is performed by supplying a cooling medium to the tank.

9. The method of claim 7 wherein the cooling medium is a water-containing liquid.

10. The method of claim 7 wherein the pressure during the cooling step is suitably controlled and adapted having regard to the temperature.

11. The method of claim 10 wherein the drying step is performed by reducing the pressure in the tank as the temperature in the tank is reduced.

12. The method of claim 1 further comprising the step of drying the wood, wherein during the drying step, the pressure is reduced according to temperature.

* * * * *